US005168931A

United States Patent [19]

Caskey et al.

[11] Patent Number: 5,168,931

[45] Date of Patent: Dec. 8, 1992

[54] FLUID CONTROL VALVE

[75] Inventors: Kenneth D. Caskey, Duncan, Okla.; Theron A. Scott, Odessa, Tex.

[73] Assignee: Halliburton Company, Duncan, Okla.

[21] Appl. No.: 768,055

[22] Filed: Sep. 30, 1991

[51] Int. Cl.[5] ..... E21B 21/00

[52] U.S. Cl. ..... 166/332; 166/373

[58] Field of Search ..... 166/319, 325, 330-334, 166/381, 373

[56] References Cited

U.S. PATENT DOCUMENTS

| | | | |
|---|---|---|---|
| 2,761,514 | 9/1956 | Coberly | 166/144 |
| 2,762,439 | 9/1956 | Pomeroy | 166/147 |
| 2,854,929 | 10/1958 | McGowen, Jr. et al. | 103/221 |
| 3,847,223 | 11/1974 | Scott et al. | 166/305 R |
| 3,850,250 | 11/1974 | Holden et al. | 166/315 |
| 4,274,490 | 6/1981 | Huckaby | 166/325 |
| 4,364,407 | 12/1982 | Hilliard | 137/71 |
| 4,467,867 | 8/1984 | Baker | 166/332 X |
| 4,586,569 | 5/1986 | Hyde | 166/317 |
| 4,590,995 | 5/1986 | Evans | 166/127 |
| 4,625,755 | 12/1986 | Reddoch | 137/327 |
| 4,691,779 | 9/1987 | McMahan et al. | 166/321 |
| 4,779,688 | 10/1988 | Baugh | 175/218 |
| 4,899,837 | 2/1990 | Baugh | 175/218 |
| 4,955,949 | 9/1990 | Bailey et al. | 137/71 |
| 4,957,167 | 9/1990 | Schultz | 166/319 |
| 4,962,819 | 10/1990 | Bailey et al. | 175/218 |
| 5,012,871 | 5/1991 | Pleasants et al. | 166/332 X |

OTHER PUBLICATIONS

Halliburton Services Sales & Service Catalog No. 43, pp. 2563-2564; 2568-2569; and 2573.

*Primary Examiner*—Thuy M. Bui

*Attorney, Agent, or Firm*—C. Dean Domingue; James R. Duzan; Neal R. Kennedy

[57] ABSTRACT

A fluid control valve for use in retaining well treatment fluids above a circulating valve and packer in a tool string. The fluid control valve comprises a ball seat with a seating surface thereon, a sealing ball for sealingly engaging the sealing surface, and a push rod. The ball seat and push rod are relatively movable so that as the packer is set and the circulating valve is moved toward a closed position, the push rod is brought into engagement with the ball so that it is moved off the ball seat, allowing fluid flow thereby. A ball cage extends from the ball seat for guiding the ball and limiting radial movement thereof when the circulating valve is open. A retrieving neck may be connected to the fluid control valve so that the fluid control valve may be retrieved while leaving the rest of the tool string in the well bore.

20 Claims, 5 Drawing Sheets

FLUID CONTROL VALVE

BACKGROUND OF THE INVENTION

1. Field of the Invention

The present invention relates to downhole injection apparatus for well treatment, and more particularly, to a fluid control valve for use with an injection packer and circulating valve. The fluid control valve designed to prevent loss of treating fluids to well formations when the packer is being moved from one position to another.

2. Description of the Prior Art

Testing and treating of well formations is, of course, well known. One apparatus useful for these purposes is the Halliburton RTTS (Retrievable Test-Treat-Squeeze) packer which is adaptable for performing multiple operations on one or more zones with one trip into the well bore. After treating one zone, the RTTS packer can be moved to other positions in the hole, where other zones can be similarly treated.

Another packer useful for treating small portions of a well formation is the Halliburton PPI (Pin Point Injection) packer which may be used to straddle sections of perforated casing a small amount at a time. The entire formation can be evenly broken down before running the main treatment because the operator can move up the casing with a series of small injections. That is, the packer may be set and used to treat a small portion of the formation and then moved to treat additional small portions.

Typically, with packers such as the RTTS packer and the PPI packer, a Halliburton RTTS circulating valve may be used for circulating fluid above the set packer and as a bypass as the tool is run into the hole. The valve is automatically locked in a closed position when the packer is set.

Tool strings using the RTTS packer or PPI packer with the RTTS circulating valve have worked well. However, in low fluid formations, it is possible that the well treating fluids may be lost to the formation when the packer is being moved. That is, some well formations will not hold a fluid column because of a low pressure zone, and the well treatment fluids may simply flow out of the tool into the well formation and be irrevocably lost. This results in lost time and increased treatment costs, both of which are undesirable.

The present invention solves these problems by providing a fluid control valve which may be used with injection packer tools such as those described above and which is designed to hold the well treating fluids above the circulating valve and thus maintain a column of fluid in the work string when the packer is moved from one setting position to another.

SUMMARY OF THE INVENTION

The present invention comprises a fluid control valve for use with injection packers and circulation valves. The valve itself generally comprises a ball seat, a ball adapted for sealingly engaging a seating surface on the ball seat and preventing fluid flow thereby, and a push rod positioned below the ball, wherein the ball seat and push rod are relatively movable such that the push rod may engage the ball and move the ball away from sealing engagement with the ball seat. Preferably, a ball cage is disposed adjacent to the ball seat and is adapted for guiding the ball when the ball is moved out of engagement with the ball seat by the push rod. That is, the ball cage allows vertical or longitudinal movement of the ball but substantially limits radial movement of the ball.

The relative initial position between the push rod and the ball seat is adjustable, and the apparatus may further comprise locking means for locking the push rod in the desired position.

The invention may also be said to include a downhole tool comprising the fluid control valve. This downhole tool may be generally said to comprise packing means for sealingly engaging a well bore adjacent to a well formation and defining a port therein through which fluids may be pumped into the formation when the packing means is set and further comprising a circulating valve adjacent to the packing means. The fluid control valve is disposed at least partially within the circulating valve and packing means. The circulating valve itself comprises a valve case connected to the packing means, a valve sleeve slidably disposed in the valve case between an open position and a closed position, and J-slot means in operative association with the valve case and valve sleeve whereby the valve sleeve may be moved between the open and closed positions.

In one embodiment as part of this downhole tool, the fluid control valve may be said to comprise a seal case, which is connected to the valve sleeve and movable therewith, and a valve means disposed in the seal case for preventing fluid flow downwardly toward said packing means and an open position for allowing fluid flow downwardly toward said packing means. Preferably, the valve means comprises the ball seat, ball and push rod.

The fluid control valve may also comprise an extension member connected to the packing means and extending upwardly therefrom. In this embodiment, the push rod is preferably engaged with this extension member and extends toward the ball. As the valve sleeve is moved from the open position thereof to the closed position, the ball seat is moved with respect to the push rod such that the push rod disengages the ball from the seating surface so that fluids are free to flow downwardly toward the packing means. The push rod is preferably threadingly engaged with the extension member, and the locking means may be characterized as a jam nut for locking the push rod in the preselected position with respect to the extension member. The fluid control valve is in an open position when the circulating valve is closed.

An important object of the present invention is to provide a fluid control valve which prevents loss of well treating fluids into a low pressure well formation when a well packer is being moved within the well bore.

Another object of the invention is to provide a fluid control valve which may be used with presently known packers and circulating valves.

A further object of the invention is to provide a downhole tool for use in well treatment at different positions in a well bore while preventing loss of well treatment fluids to any low pressure zones therein.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1A:
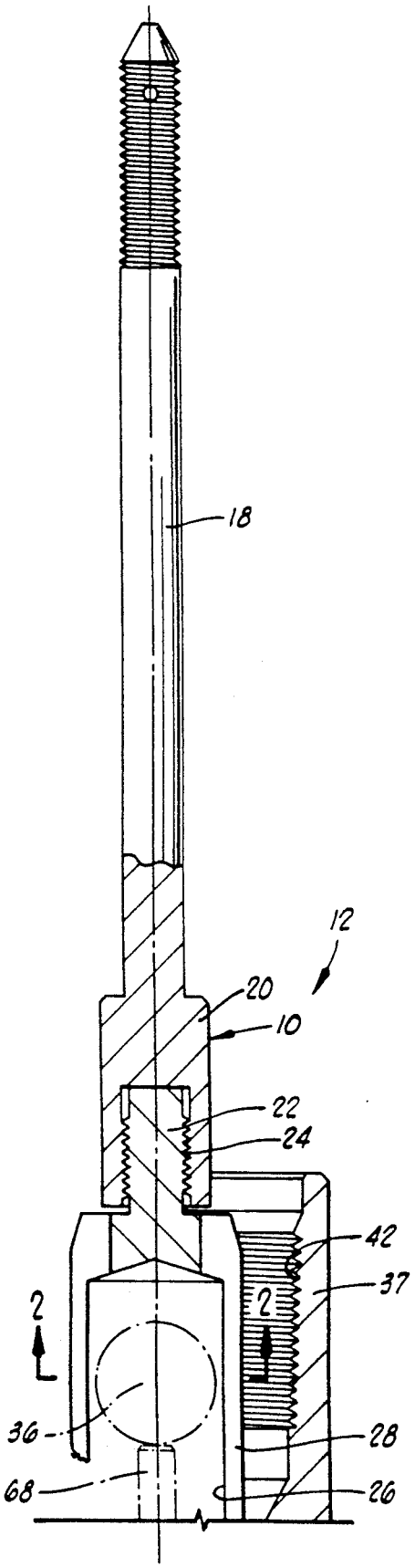
FIGS. 1A-1H show a longitudinal cross section of the fluid control valve of the present invention as part of a tool string including a circulating valve and a packing means.

Referring now to the drawings, and more particularly to FIGS. 1A-1H, the fluid control valve of the present invention is shown and generally designated by the numeral 10. Fluid control valve 10 is shown at the upper end of a tool string or downhole tool 12 which also includes a circulating valve 14, such as the Halliburton RTTS circulating valve or similar device, and a packing means 16, such as the Halliburton PPI packer, RTTS packer or similar device. The invention is not intended to be limited to any particular circulating valve or packing means.

Referring to FIG. 1A, fluid control valve 10 has at its upper end a retrieving neck 18. Retrieving neck 18 is adapted for grappling by a retrieving tool of a kind known in the art.

Enlarged lower end 20 of retrieving neck 18 is connected to the upper end of a ball cage 22 at threaded connection 24.

Figure 2:
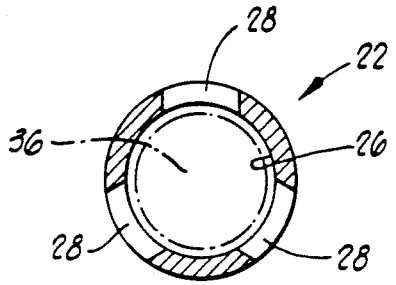
FIG. 2 shows a cross section taken along lines 2—2 in FIG. 1A.

Ball cage 22 defines an elongated bore 26 therein. A plurality of longitudinal slots 28 are defined through the wall of ball cage 22 and thus are in communication with bore 26. As seen in FIG. 2, three such slots 28 are defined in ball cage 22, but the invention is not intended to be limited to any particular number of slots.

Figure 1B:
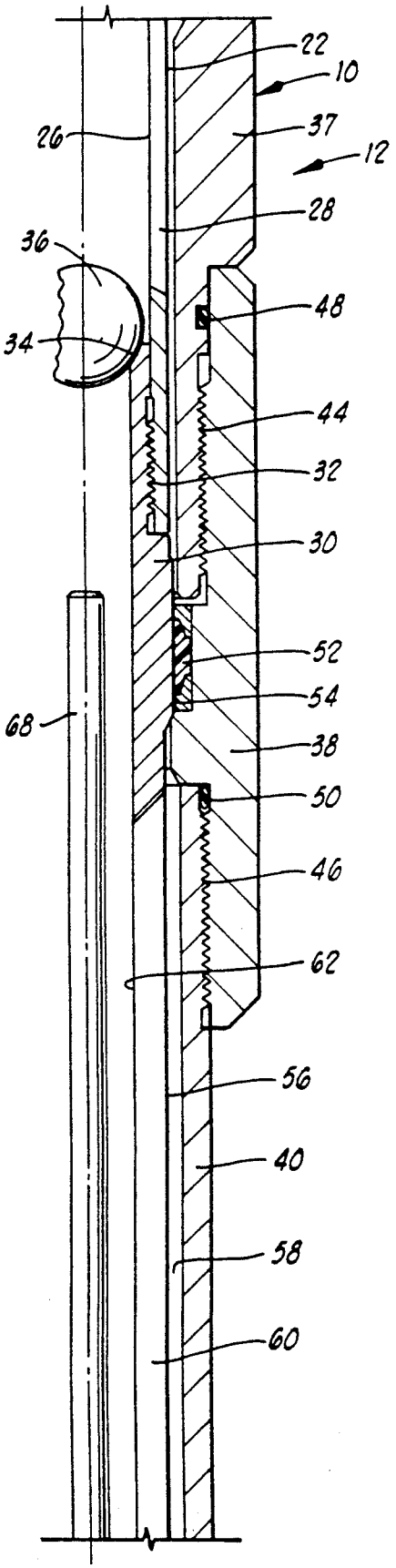

Referring now to FIG. 1B, the lower end of ball cage 22 is attached to a ball seat 30 at threaded connection 32. At the upper end of ball seat 30 is a ball seating surface 34 which is adapted for engagement by a sealing ball 36. Ball 36 is sized to fit within bore 26 in ball cage 22, and, as will be further discussed herein, ball 36 is thus free to move vertically or longitudinally within the ball cage. However, ball cage 22 will act as a guide for ball 36 and limit any movement of the ball in a radial direction.

It will be seen in FIGS. 1A and 1B that ball cage 22 and ball seat 30 are disposed within a housing means formed by an upper adapter 37, a seal housing 38 and the upper end of a J-slot mandrel 40. Upper adapter 37 has an internally threaded upper end 42 which is adapted for engagement with an upper tool string portion. The lower end of upper adapter 37 is attached to seal housing 38 at threaded connection 44, and seal housing 38 is attached to J-slot mandrel 40 at threaded connection 46. Sealing means, such as O-rings 48 and 50 provide sealing engagement between upper adapter 37 and seal housing 38 and between seal housing 38 and J-slot mandrel 40, respectively.

Figure 3:
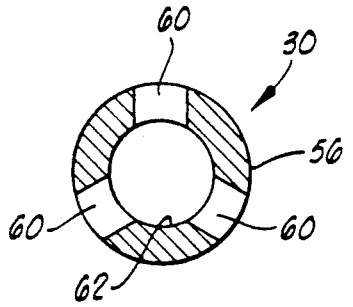
FIG. 3 is a cross section taken along lines 3—3 in FIG. 1C.

Another sealing means, such as seal 52, provides sealing engagement between seal housing 38 and outer surface 54 of ball seat 30. Ball seat 30 has a smaller, second outer surface 56 which is spaced radially inwardly from J-slot mandrel 42 such that an annulus 58 is defined therebetween. Ball seat 30 defines a plurality of longitudinal slots 60 therein which are in communication with annulus 58. See also FIG. 1C. As shown in FIG. 3, three such slots 60 are illustrated, but the invention is not intended to be limited to any particular number of slots.

Ball seat 30 defines a first bore 62 therethrough which is smaller than the diameter of ball 36. At the lower end of ball seat 30 is a smaller second bore 64. An upwardly facing shoulder 66 extends between second bore 64 and first bore 62.

Figure 1C:
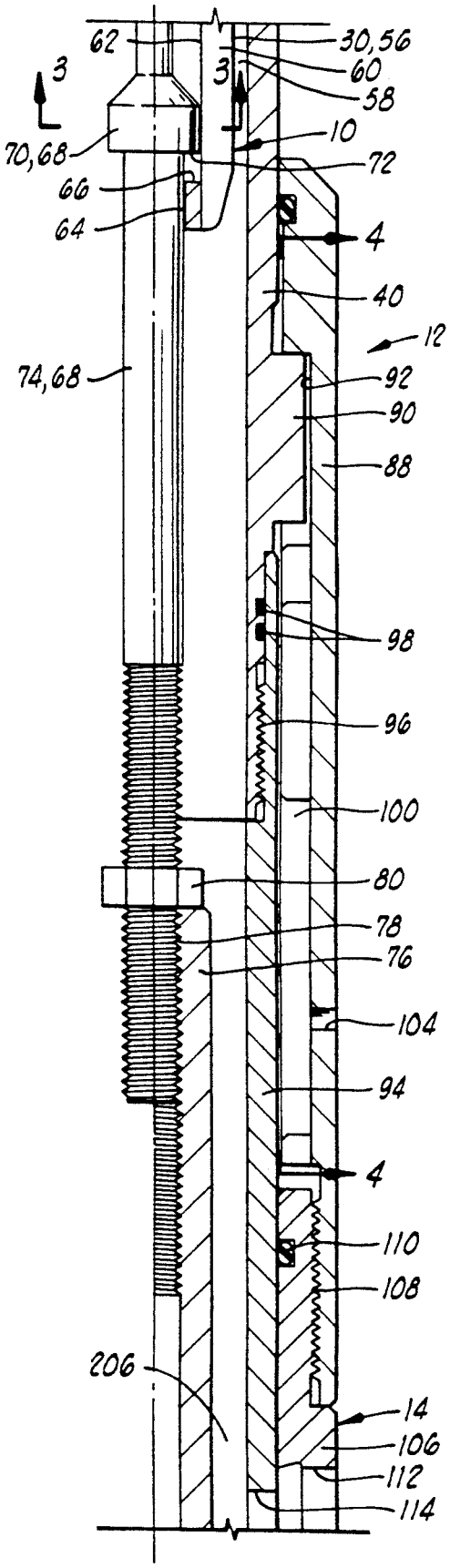

Referring to FIGS. 1B and 1C, a push rod 68 is disposed at least partially within ball seat 30. As seen in FIG. 1C, an enlarged portion 70 is formed on push rod 68 and defines a downwardly facing shoulder 72 which generally faces shoulder 66 on ball seat 30 and is adapted for engagement therewith during retrieval, as will be further discussed herein.

Lower end 74 of push rod 68 is threadingly engaged with standing valve extension member 76. It will be seen that the length of threaded engagement 78 between push rod 68 and extension member 76, and thus the length of push rod 68 which extends from extension member 76, may be easily varied. A jam nut 80 is used as a locking means for locking push rod 68 with respect to extension member 76 once the desired threaded engagement 78 therebetween is selected.

Extension member 76 extends downwardly through circulating valve 14 and into packing means 16 (see FIGS. 1C-1E) and is attached to a standing valve 82 in packing means 16 at threaded connection 84. A set screw 86 locks standing valve extension member 76 to standing valve 82. Standing valve 82 is the normal standing valve in a packing means 16 such as the Halliburton PPI packer illustrated.

Figure 4:
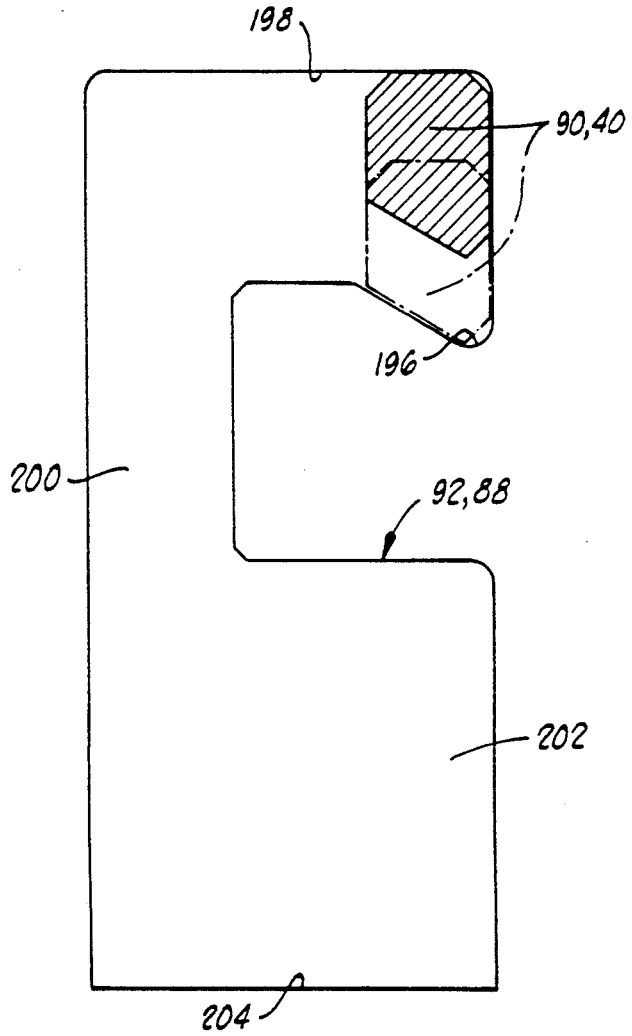
FIG. 4 is a view of a circulating valve J-slot as seen along lines 4—4 in FIG. 1C.

Referring again to FIG. 1C, J-slot mandrel 40 forms part of circulating valve 12, and the lower end of the J-slot mandrel is positioned in a J-slot case 88. J-slot mandrel 40 has an outwardly extending lug 90 thereon which extends into, and interacts with, a J-slot 92 defined in J-slot case 88. The pattern of J-slot 92 is best seen in FIG. 4. J-slot mandrel 40 and J-slot 92 thus form a J-slot means of a kind known in the art.

The lower end of J-slot mandrel 40 is attached to a valve sleeve 94 at threaded connection 96. A sealing means, such as a pair of O-rings 98, provide sealing engagement between J-slot mandrel 40 and valve sleeve 94.

An annulus 100 is defined between J-slot case 88 and valve sleeve 94. J-slot case 88 defines a port 104 which provides communication between annulus 100 and the well annulus of outside of tool string 12. Thus, pressure in annulus 100 is always equalized with the well annulus regardless of the position of J-slot mandrel 40 and valve sleeve 94.

The lower end of J-slot case 88 is connected to a valve case 106 at threaded connection 108. A sealing means, such as O-ring 110, provides sealing engagement between valve case 106 and valve sleeve 94 below annulus 100.

Figure 1D:
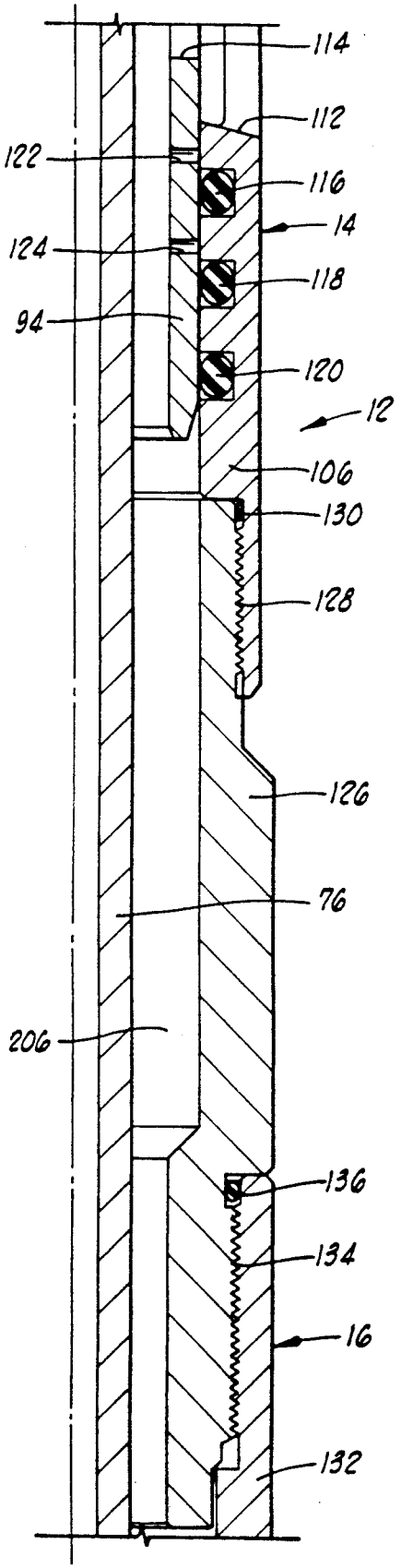

Referring also to FIG. 1D, valve case 106 defines a case circulating port 112 therethrough which is initially in communication with valve circulating port 114 defined in valve sleeve 94. This defines an open position of circulating valve 14. It will be seen that valve sleeve 94 may be moved somewhat downwardly while valve circulating port 114 and case circulating port 112 are still in communication with one another. Thus, the open position of circulating valve 14 is variable.

Below case circulating port 112, a sealing means is provided for sealing between valve case 106 and valve sleeve 94. In the embodiment shown, the sealing means comprises three large O-ring seals 116, 118 and 120.

At the lower end of valve sleeve 94 are a pair of small vent ports 122 and 124. In the initial position shown in FIG. 1D, vent ports 122 and 124 are located on opposite sides of O-ring 116. Vent ports 122 and 124 prevent pressure buildup across the O-rings when tool string 12 is run into the well bore.

The lower end of valve case 106 is attached to a center adapter 126 at threaded connection 128. A sealing means, such as O-ring 130, provides sealing engagement between valve case 106 and center adapter 126. The lower end of center adapter 126 is attached to hydraulic slip body 132 at threaded connection 134. Hydraulic slip body 132 is an upper portion of packing means 16. A sealing means, such as an O-ring 136, provides sealing engagement between center adapter 126 and hydraulic slip body 132.

The general construction of packing means 16 will now be generally discussed. However, since the embodiment of packing means 16 illustrated is the prior art Halliburton PPI packer, this disclosure will not go into great detail.

Figure 1E:
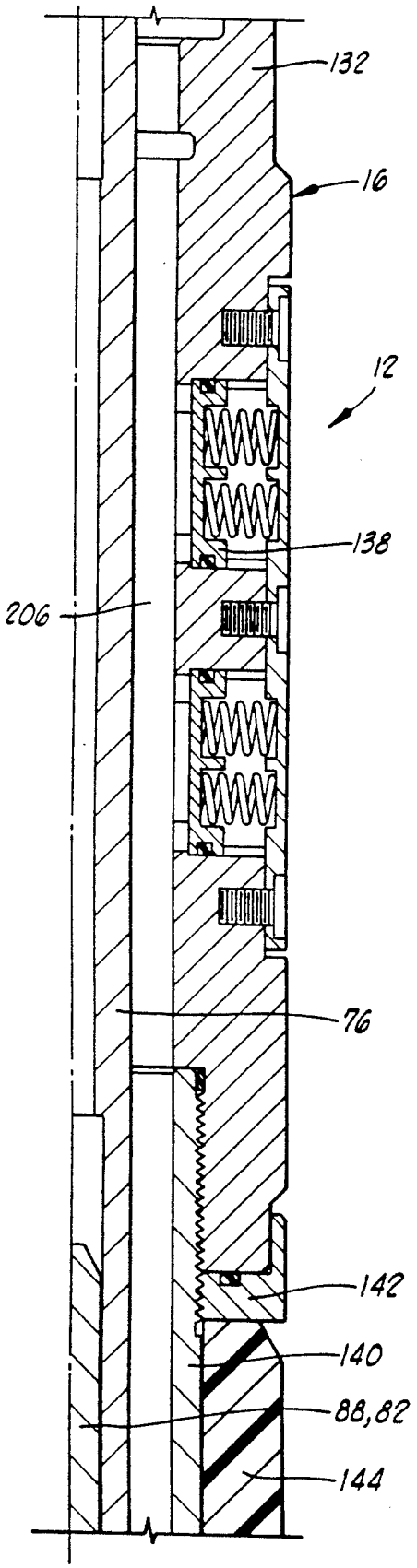

Referring now to FIG. 1E, hydraulic slip body 132 has a plurality of hydraulic slips 138 therein. Hydraulic slip body is attached to an upper packer mandrel 140 adjacent to a first upper packer shoe 142.

Figure 1F:
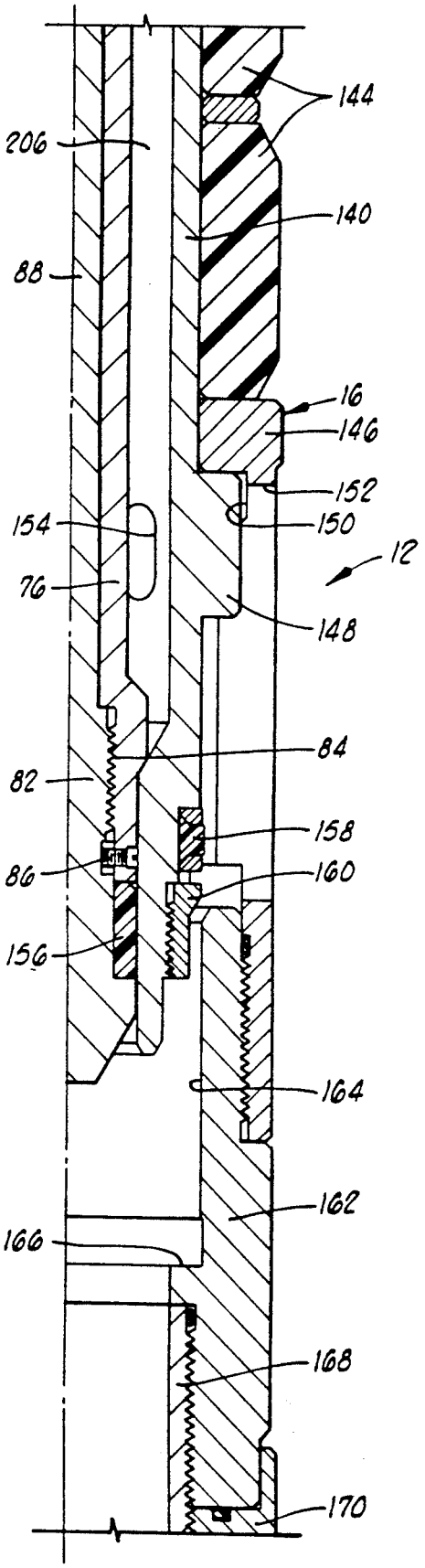

Referring now to FIGS. 1E and 1F, a pair of packer elements 144 are disposed on upper packer mandrel 140 above a first lower packer shoe 146.

The lower end of upper packer mandrel 140 has a J-slot lug 148 extending therefrom and into a J-slot 150 defined in lower packer shoe 146. The interaction and configuration of J-slot lug 148 and J-slot 150 is of a kind known in the art.

Also defined in lower packer shoe 146 is an injection port 152 which is in communication with a plurality of mandrel ports 154 defined in upper packer mandrel 140.

The lower ends of standing valve 82 and standing valve extension member 76 are positioned in the lower portion of upper packer mandrel 140. A seal 156 provides sealing engagement between standing valve 82 and upper packer mandrel 140.

On the outside lower portion of upper packer mandrel 140 are a packer seal 158 and a seal retainer 160.

Figure 1G:
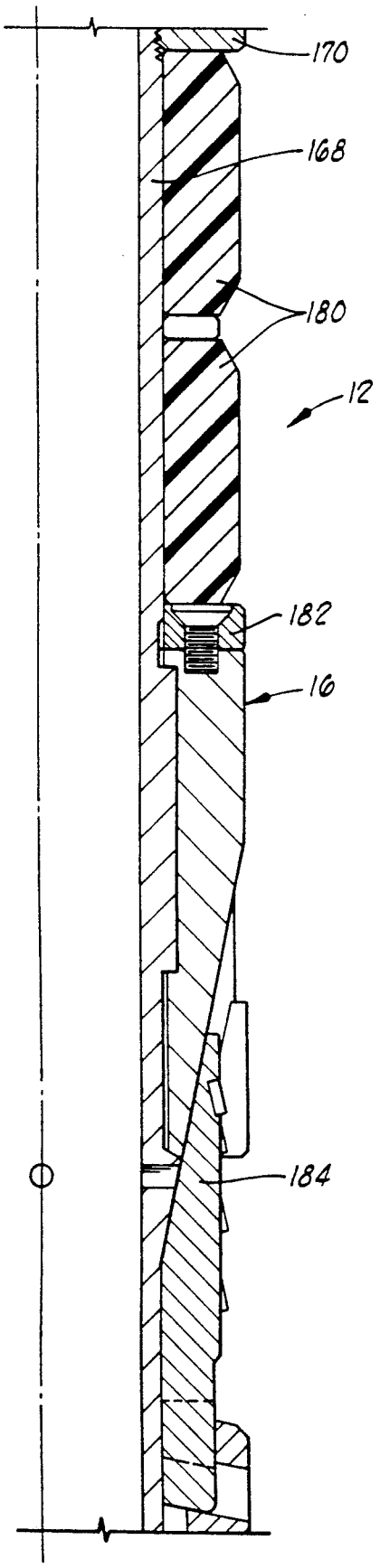

The lower end of lower packer shoe 148 is connected to a packer adapter 162 which defines a bore 164 therein and an upwardly facing shoulder 166. Referring now to FIGS. 1F and 1G, the lower packer adapter 162 is attached to a lower packer mandrel 168 adjacent to a second upper packer shoe 170. Below upper packer shoe 170 are a pair of packer elements 180. Below packer elements 180 are a second lower packer shoe 182 and a plurality of mechanical slips 184.

Figure 1H:
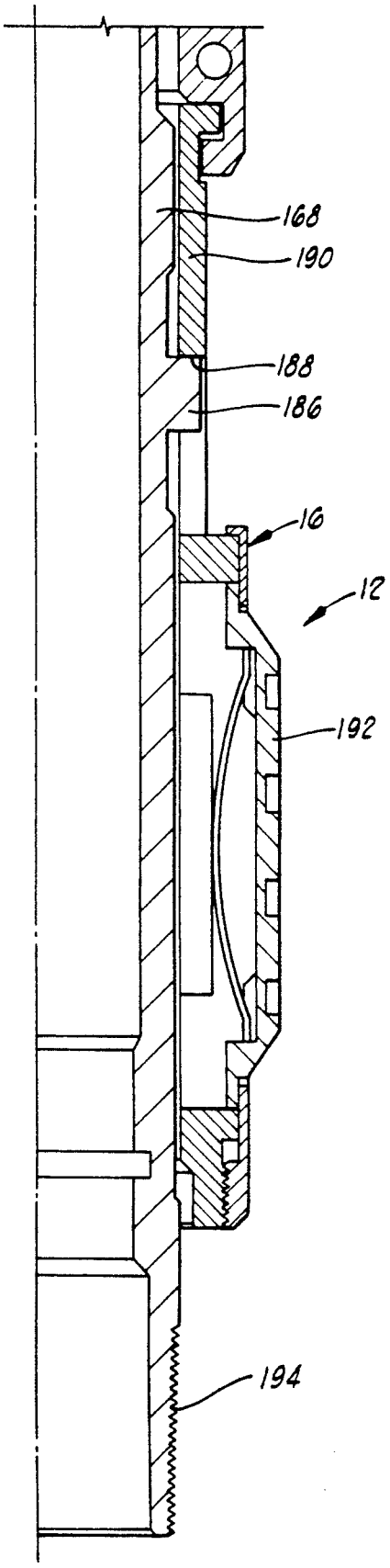

Referring now to FIG. 1H, lower packer mandrel 168 has a J-slot lug 186 thereon which interacts with a J-slot 188 in a drag block body 190. Drag block 190 is connected to mechanical slips 184 and has a plurality of drag blocks 192 therein. The lower end of lower packer mandrel 168 has an externally threaded surface 194 thereon which is adapted for connection to a lower tool string portion below packer means 16.

OPERATION OF THE INVENTION

The components of tool string 12 are in the positions shown in FIGS. 1A–1H as the tool string is run into the well bore. In this position, ball 36 is seated against sealing surface 34 in ball seat 30. Because of this engagement and the sealing engagement by seal 52 against first outer surface 54 of ball seat 30, any column of well treating fluids in the tool string above ball 36 and seal 52 is retained and cannot be lost downwardly to the well annulus through circulating valve 14 or packing means 16.

Once the apparatus is located in the desired position in the well bore, packing means 16 is set in a manner known in the art. Weight is picked up on tool string 12, right-hand rotation is applied and weight is then set down. This actuates mechanical slips 184 into gripping engagement with the well bore. Mechanical slips 184 and packer seals 144 and 180 are prevented from rotation during this operation by drag blocks 192. Also in the setting operation, packer elements 180 are compressed into sealing engagement with the well bore below the well formation portion to be tested, and packer elements 144 are squeezed into sealing engagement with the well bore above the well formation portion.

As upper packer mandrel 140 in packing means 16 is moved downwardly with respect to lower packer shoe 146, seal 158 is brought into sealing engagement with bore 164 in packer adapter 162. Thus, no fluids in the tool string may be pumped downwardly past seal 158 once packing means 16 is set.

While packer means 16 is being set, circulating valve 12 also is actuated toward a closed position. Initially, lug 90 on J-slot mandrel 40 is engaged with first portion 196 of J-slot 92 as shown by phantom lines in FIG. 4. As weight is picked up on tool string 12, lug 90 is moved into engagement with upper surface 198 of J-slot 92. As right-hand rotation is applied, lug 90 is brought into alignment with elongated second portion 200 of J-slot 92. When weight is set down, lug 90 is moved downwardly through second portion 200 into enlarged lower portion 202. This is all carried out in a manner known in the art.

As J-slot mandrel 40 is thus moved downwardly, valve sleeve 94 will also be moved downwardly through valve case 106. Downward movement of lug 90 is limited by engagement of seal housing 38 with J-slot case 88. Lug 90 never actually contacts lower surface 204 in J-slot 92. This lowermost position locates valve circulating port 114 below O-rings 116, 118 and 120 so that the valve circulating port is no longer in communication with case circulating port 112.

As circulating valve 12 is thus closed, it will be seen that the downward movement of J-slot mandrel 40 results in relative movement of ball seat 30 with respect to push rod 68. This occurs because of the gripping, sealing engagement of seal 52 with ball seat 30 which causes ball seat 30 to move downwardly with the outer portion of the tool string. As a result of this downward movement, ball 36 is brought into engagement with the upper end of push rod 68 which pushes ball 36 off of seating surface 34 on ball seat 30. At this point, the treating fluids above ball 36 and seal 52 will flow downwardly through slots 28 in ball cage 22, around ball 36 and into ball seat 30. Thus, ball 36, ball seat 30 and push rod 68 act as a valve means for defining closed and open positions of fluid control valve 10.

Fluid will flow further downwardly through slots 60 in ball seat 30 and into an annulus 206 defined between standing valve extension member 76 and circulating valve 12 and between standing valve extension member 76 and packing means 16. These well treatment fluids may then be pumped downwardly through annulus 206, through mandrel ports 154 in upper packer mandrel 140 and out into the well formation through injection port 152 in lower packer shoe 146 of packing means 16.

After the formation has been treated, weight may be picked up on the tool string which will reopen circulating valve 14 and raise ball seat 30 upwardly with respect to push rod 68 such that ball 36 is again free to seat against seating surface 34 in ball seat 30. Ball 36 is always in sealing engagement with seating surface 34 when circulating valve 12 is open, and ball 36 is always pushed away from ball seat 30 when circulating valve 12 is closed.

When ball 36 is again in sealing engagement with seating surface 34 of ball seat 30, well treatment fluid above ball 36 and seal 52 is again prevented from flowing downwardly toward packing means 16. The tool may then be retrieved and moved to a different location in the well bore or removed from the well bore as desired. If relocated in the well bore, the abovedescribed operation may be carried out once again.

If desired, fluid control valve 10 may be retrieved separately from the rest of tool string 12. A retrieving tool of a kind known in the art is lowered into the tool string on a wire line and engaged with the upper end of retrieving neck 18. By lifting on the wire line, retrieving neck 18, ball cage 22 and ball seat 30 are moved upwardly. Referring to FIG. 1C, shoulder 66 in ball seat 30 will be moved upwardly into engagement with shoulder 72 on push rod 68 so that the push rod is also moved upwardly. Retrieved along with push rod 68 is standing valve extension member 76 and standing valve 82 connected thereto. As standing valve 82 is moved out of packing means 16, seal 156 is no longer sealingly engaged with upper packer mandrel 140. Thus, after fluid control valve 10 is retrieved, fluids may be pumped downwardly through the center of circulating valve 14 and packing means 16 as desired.

It will be seen, therefore, that the fluid control valve of the present invention is well adapted to carry out the ends and advantages mentioned as well as those inherent therein. While a preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A fluid control valve comprising:
a ball seat;
a ball adapted for sealingly engaging said ball seat and preventing fluid flow thereby; and
a push rod positioned below said ball, wherein said ball seat and said push rod are relatively movable such that said push rod may engage said ball and move said ball away from sealing engagement with said ball seat.

2. The valve of claim 1 further comprising:
a ball cage disposed adjacent to said ball seat and adapted for guiding said ball when said ball is moved out of engagement with said ball seat by said push rod.

3. The valve of claim 2 wherein said ball cage defines a slot therein for allowing fluid flow therethrough.

4. The valve of claim 2 further comprising a retrieving neck extending from said ball cage.

5. The valve of claim 1 wherein a relative initial position between said push rod and said ball seat is adjustable.

6. The valve of claim 5 further comprising locking means for locking said push rod in said position.

7. The valve of claim 1 wherein said ball seat defines a slot below said ball.

8. A downhole tool comprising:
a valve case defining a case circulating port therein;
a valve sleeve slidably disposed in said valve case and defining a valve circulating port therein, said valve circulating port being in communication with said case circulating port when said valve sleeve is in an open position; and
a fluid control valve having an open position and further having a closing position for preventing fluid flow downwardly therethrough, said fluid control valve being in said closed position when said valve sleeve is in said open position thereof; wherein:
said valve sleeve is slidable to a closed position wherein said valve circulating port is out of communication with said case circulating port; and
as said valve sleeve is moved toward said closed position, said fluid control valve is moved to said open position thereof.

9. The tool of claim 8 wherein said fluid control valve comprises:
a seal housing connected to said valve sleeve;
a ball seat disposed in said seal housing and defining a seating surface thereon;
a ball adapted for sealing engagement with said seating surface when said fluid control valve is in said closed position thereof; and
a push rod below said ball;
wherein, as said valve sleeve is moved toward said closed position, said ball seat is moved with respect to said push rod such that said ball is moved out of engagement with said seating surface by said push rod, thereby opening said fluid control valve.

10. The tool of claim 9 further comprising a ball cage extending from said ball seat for allowing vertical movement of said ball by engagement with said push rod and limiting radial movement of said ball.

11. The tool of claim 9 further comprising an extension member disposed in said valve case; and
wherein said push rod is variably engaged with said extension member such that an initial relative position between said push rod and said seating surface may be preselected.

12. The tool of claim 9 further comprising means for retrieving said ball seat, ball and push rod from said seal case and said valve case.

13. A downhole tool comprising:
packing means for sealingly engaging a well bore adjacent to a well formation and defining a port therein through which fluids may be pumped into said formation when said packing means is set;
a circulating valve comprising:
a valve case connected to said packing means;
a valve sleeve slidably disposed in said valve case between an open position, whereby fluids may be circulated through a well annulus defined above said packing means, and a closed position; and
J-slot means in operative association with said case and valve sleeve whereby said valve sleeve may be moved between said open and closed positions; and a fluid control valve comprising:

a seal case connected to said valve sleeve and movable therewith; and valve means disposed in said seal case for defining a closed position of said fluid control valve and preventing fluid flow downwardly therethrough toward said packing means and for defining an open position for allowing fluid flow downwardly to said packing means;

wherein, as said valve sleeve is moved from said open position thereof to said closed position, said valve means in said fluid control valve is moved from said closed position to said open position thereof.

14. The tool of claim 13 wherein said valve means in said fluid control valve comprises:

a ball seat disposed in said seal case and movable therewith, said ball seat defining a seating surface thereon;

a ball adapted for sealing engagement with said seating surface;

an extension member connected to said packing means and extending upwardly therefrom; and a push rod engaged with said extension member and extending toward said ball;

wherein, as said valve sleeve is moved from said open position thereof to said closed position, said ball seat is moved with respect to said push rod such that said push rod disengages said ball from said seating surface thereby opening said valve means so that fluids are free to flow downwardly toward said packing means.

15. The tool of claim 14 further comprising a ball cage extending from said ball seat for radially retaining said ball while allowing relative longitudinal movement of said ball as a result of said engagement by said push rod.

16. The tool of claim 15 further comprising a retrieving neck extending from said ball cage whereby said fluid control valve may be retrieved from said circulating valve and said packing means.

17. The tool of claim 14 wherein a length of extension of said push rod from said extension member is variable.

18. The tool of claim 17 wherein said push rod is threadingly engaged with said extension member and further comprising a jam nut for locking said push rod in a preselected position with respect to said extension member.

19. The tool of claim 13 further comprising sealing means for sealing between said seal case and said ball seat.

20. The tool of claim 19 wherein said fluid control valve is in said open position when said circulating valve is closed.

* * * * *